US006494811B1

(12) United States Patent
Alessandri

(10) Patent No.: US 6,494,811 B1
(45) Date of Patent: Dec. 17, 2002

(54) MEASURING UNIT FOR A WEIGHT-STACK GYM MACHINE

(75) Inventor: Nerio Alessandri, Longiano (IT)

(73) Assignee: Technogym S.r.l., Gambettola (IT)

( * ) Notice: Subject to any disclaimer, the term of this patent is extended or adjusted under 35 U.S.C. 154(b) by 0 days.

(21) Appl. No.: 09/468,801

(22) Filed: Dec. 21, 1999

(30) Foreign Application Priority Data

Dec. 21, 1998 (IT) ..... B098A0710

(51) Int. Cl.[7] ..... A63B 71/00; A63B 21/062
(52) U.S. Cl. ..... 482/8; 482/99; 482/900
(58) Field of Search ..... 482/1, 3–9, 900–902, 482/92–94, 98–103; 73/379.01, 379.03, 379.08

(56) References Cited

U.S. PATENT DOCUMENTS

| | | | | |
|---|---|---|---|---|
| 4,779,865 A | | 10/1988 | Lieberman et al. | |
| 4,817,940 A | | 4/1989 | Shaw et al. | |
| 5,605,336 A | | 2/1997 | Gaoiran et al. | |
| 5,655,997 A | | 8/1997 | Greenberg et al. | |
| 5,785,632 A | | 7/1998 | Greenberg et al. | |
| 5,797,809 A | * | 8/1998 | Hyuga | 473/407 |

FOREIGN PATENT DOCUMENTS

| | | |
|---|---|---|
| DE | 8502372 | 6/1986 |
| DE | 8801538 | 4/1988 |
| DE | 3807038 | 9/1989 |
| DE | 4433046 | 3/1996 |
| FR | 2731627 | 9/1996 |
| JP | 10-230021 | 9/1998 |
| WO | 87/05727 | 9/1987 |
| WO | WO 99/43393 | 9/1999 |

OTHER PUBLICATIONS

Derwent Publications Ltd., Eriksson et al., Movement Value Recorder for Muscle Training Appts. with Elements Movable to=and=fro Against Gravity—has Load Monitor Supplying Signals to Computer for Processing and/or Storing Internally or on Separate Data Carrier, Database WPI, Section PQ, Week 199337, Class P36, AN 1993–293367, XP002143485.

* cited by examiner

*Primary Examiner*—Denise M. Pothier
(74) *Attorney, Agent, or Firm*—Arent Fox Kintner Plotkin & Kahn, PLLC

(57) ABSTRACT

The invention relates to a measuring unit for a weight-stack gym machine where a frame supports a load unit equipped with a plurality of substantially identical weights. The weights have a hole through them to form a vertical channel for a load selecting bar. A remote load measuring unit is envisaged to calculate static and dynamic training parameters.

24 Claims, 4 Drawing Sheets

MEASURING UNIT FOR A WEIGHT-STACK GYM MACHINE

BACKGROUND OF THE INVENTION

The present invention relates to a measuring unit for a weight-stack gym machine. The unit can be effectively used to measure the static and dynamic (or training) parameters connected with the load that can be lifted by a user performing an exercise.

For the measurement of these parameters, known systems include devices of an electromechanical and mixed electromechanical and optical type. Of these, the ones described in the following patent documents are worthy of note: patent application PCT WO 87/05727 filed in the name of the American company Physio Decisions, Inc. with priority date Mar. 10, 1986; U.S. Pat. No. 4,817,940 granted to the American company Fike Corporation, with priority date Apr. 4, 1986, and U.S. Pat. Nos. 5,655,977 and 5,785,632 granted to Integrated Fitness Corporation with priority dates Jul. 7, 1994 and Mar. 7, 1997.

Since experts in the trade are well aware of the teachings of these documents, the text which follows will only describe those aspects which evidence the drawbacks of the measuring units disclosed therein.

Firstly, it should be noted that all the above mentioned documents refer to gym machines where the load unit has a plurality of weights with a given thickness and slidably mounted on vertical bars. The weights can be lifted vertically by the user through a load unit comprising a bar, normally called through bar which goes through a vertical hole made in the middle of all the weights. Each weight also has a transversal hole made centrally in its side and the through bar has a plurality of transversal holes distributed along its length equally spaced according to the thickness of the weights so that when the weights are at rest, each of the holes in the through bar is aligned with the corresponding hole in each of the weights. The user selects the load to be lifted while the weights are at rest, supported by the frame, by inserting a transversal pin through one of the weights and into the corresponding hole in the through bar.

The above mentioned documents described measuring units equipped with an electrical position transducer, usually called "encoder". This instrument normally includes a processor to which a rotary element is electrically connected in such a way that its angular position can be measured instant by instant. Thus, used in a weight lifting device having a flexible cable, it can keep track of the current position of the weight to be lifted relative to a reference position.

Document U.S. Pat. No. 4,817,940 describes a direct readout, digital encoder where a mechanical transmission pulley used to lift the weights has a plurality of holes made in it, the holes being equally spaced around the axis of rotation. The pulley is located between a light emitter and a light receiver. The alternation of light and dark pulses or a permanent dark signal provide the information used by the control unit to track the position of the load being lifted.

Document PCT WO 87/05727 is the first document which suggests the use of a "wire encoder". This instrument, which comprises a tachogenerator and an automatic cable reel whose cylinder is coaxial with the axis of the tachogenerator, is connected to an electronic control unit that processes the position signal provided by the encoder and combines it with a time signal to provide as its output the speed and acceleration of the through bar while the machine is being used. The combination of this information, which is necessarily recorded by the control unit, and the values of speed and acceleration enable the control unit to calculate the dynamic parameters such as, for example, the instantaneous power exerted by the user and the total energy used at the end of the exercise. In this case, the encoder is connected to the weight stack and, in particular, to the pin used to select the load to be lifted. Thus, the detecting device permits measurement of the load selected by the user when the weights are at rest, with reference to the initial position of the pin relative to an initial encoder reference, that is, before the exercise starts.

In documents U.S. Pat. Nos. 5,655,997 and 5,785,632, the encoder wire is connected to the weight at the top of the weight stack and an optical device having the function of a switch permits calculation of the total thickness of the weights lifted by the user. The interruption of a light beam by the weights tack and the subsequent return to a continuous light beam condition, combined with the measurement of load movement by the encoder, enables the control unit to calculate the total load lifted.

Each of the measuring devices described in the above mentioned documents has drawbacks, some of which are common to more than one device.

Firstly, in the measuring devices equipped with wire encoder (PCT WO 87/05727, U.S. Pat. Nos. 5,655,977 and 5,785,632), the main disadvantage is the fact that the devices which define the change between the static position (where the number of weights selected, that is, the load, is measured) and the dynamic position (corresponding to the movement of the weight pack selected by the user) do not guarantee constant, reliable operation. For example, photocells may be blacked out by dust or they may move out of position as a result of the vibrations which are always present on machines of this kind. That means the state of the system must be periodically checked in order to prevent failure while an exercise is being performed.

The device described in document U.S. Pat. No. 4,817,940 is also negatively affected by wear since the load to be lifted acts directly on the pulley that constitutes the encoder which, in turn, transmits the stress to a pin supported by the frame. Further, in a measuring device based on an encoder of this kind, the static load must be set by the user and only on the basis of this information can the control unit calculate the training parameters. Consequently, incorrect programming by the user may result in the parameters being calculated inaccurately.

Moreover, although the encoder described in document WO 87/05727 is sufficient to measure the total lifted load and the training parameters, in patents U.S. Pat. No. 4,1817,940, U.S. Pat. No. 5,655,977 and U.S. Pat. No. 5,785,632, the calculation of the training parameter is performed by two separate devices. As is known, the duplication of the devices negatively affects the efficiency of the machine because the problems of one measuring device combine with those of the other to double the operating problems of the machine as a whole. Furthermore, the electronic control unit forming part of the measuring device must have two inputs for the signals corresponding to the static load and the training parameters.

SUMMARY OF THE INVENTION

The aim of the present invention is to provide a measuring unit for a weight-stack gym machine that is not subject to the drawbacks described above.

In particular, the present invention has for an object to provide a measuring unit for gym machines that permits automatic calculation of the parameters relative to the movement of the weights which form part of the training load, thus obviating problems due to wear, and using reliable measuring elements which can be retrofitted on existing machines without particular technical problems tending to radically modify the computing components of the machine.

Accordingly, the present invention provides a measuring unit for a weight-stack gym machine.

BRIEF DESCRIPTION OF THE DRAWINGS

The present invention will now be described, with reference to the accompanying drawings, which illustrate preferred embodiments of the invention and in which.

DESCRIPTION OF THE PREFERRED EMBODIMENTS

Figure 1:
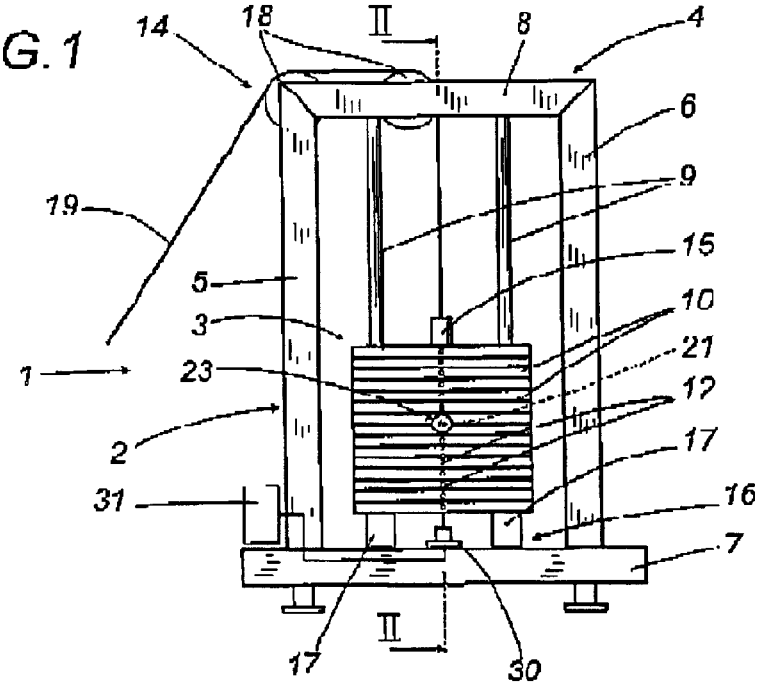
FIG. 1 is a front view, with some parts cut away for clarity, of a part of a weight-stack gym machine equipped with a first preferred embodiment of the measuring unit made according to the present invention.

In FIG. 1, the numeral 1 indicates a measuring unit for a weight-stack gym machine 2 which has been purposely represented in simplified form without thereby losing in generality.

Figure 2:
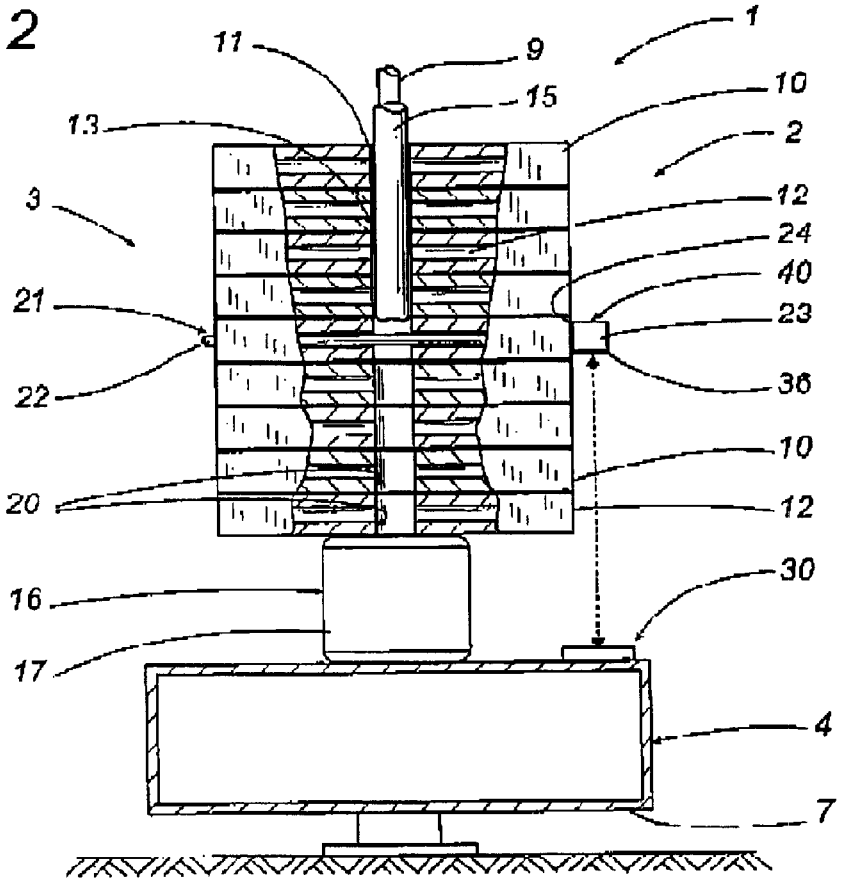
FIG. 2 is a scaled-up view, with some parts cut away for clarity, of a cross section through line II—II shown in FIG. 1.

With reference to FIGS. 1 and 2, the machine 2 comprises a load unit 3 mounted on a welded, tubular frame 4. The frame 4 comprises two uprights 5 and 6 and two crossbars 7 and 8, respectively upper and lower, and is further equipped with feet of conventional type and therefore not illustrated. The load unit 3 also comprises a pair of vertical rods 9 mounted on the frame 4 between the crossbars 7 and 8. These rods 9 are designed to guide the vertical movement of a plurality of weights 10, that are substantially parallel-epipedal in shape, each of which has, with reference only FIG. 2, a vertical hole 11 made in the middle of it. The weights 10 and the holes 11 together form a vertical channel 13 delimited by substantially cylindrical walls. Again with reference to FIG. 2 only, each weight 10 has a horizontal through hole 12 which runs diametrically across the hole 11 in the weight 10.

The load unit 3 further comprises a lifting device 14 equipped with a bar (or through bar) 15 which is normally housed inside the vertical channel 13 formed by the hole 11 as a whole. The unit 3 also comprises a stopping device 16 including a pair of stop blocks 17 positioned at the bottom of the rods 9 in such a way as to support the weight 10 and the weights on top of that when these are in the rest position. The load unit 3 also comprises a plurality of transmission pulleys 18 around which there is wound a flexible cable 19 positioned between the through bar 15 and a conventional exercising tool (not illustrated) which can be used to perform an exercise during which the weights 10 must be lifted.

The through bar 15 has a plurality of horizontal, transversal holes 20, each of which lines up with one of the holes 12 when the weights 10 are stacked on each other and in the rest position. The load unit 3 further comprises a load selection element which, for convenience, is represented as the pin 21 in FIGS. 1 and 2. With reference to FIG. 2 in particular, the pin 21 has a handgrip 23 and ends with a stem 22 that can be inserted into a pair of holes 12 and 20 which are lined up with one another. During use, a front portion 24 of the pin 21 is in contact with the front face of the corresponding weight 10 and is designed to join a given weight 10 to the through bar 15 in such a way as to divide the pack of weights 10 into two groups. In particular, the load to be lifted includes the weight 10 selected by the pin 21 and the weights 10 located above the selected one.

Again with reference to FIG. 1, the measuring unit 1 comprises an electronic card 30 mounted on the crossbar 7 under the lowermost weight 10. The unit 1 also comprises an electronic control unit 31 mounted on the crossbar 7 next to the card 30 and electronically connected to the card in such a way as to control its operation.

Figure 3:
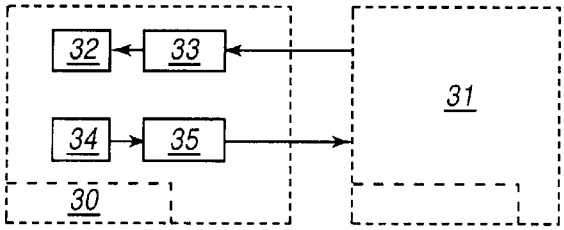
FIG. 3 is a scaled-up plan view, with some parts cut away for clarity, of a detail from FIG. 1 illustrated in the form of a block diagram.

In FIG. 3, the card 30 and the control unit 31 are illustrated in the form of a block diagram. The card 30 comprises an electromagnetic wave emitter element 32 that is electronically connected to the control unit 31 through a digital driver 33 designed to control the emission of packets of electromagnetic waves. The card 30 also comprises an electromagnetic wave receiver element including at least one sensor 34 screened from visible light and connected to the control unit 31 through an analog filter 35 designed to clean the signal sent by the sensor 34 to the control unit 31.

As is known, to keep track of the position of a moving body, such as for example, the group of weights 10 isolated by the pin 21, it is necessary to fix to the moving body a reflecting element in such a way that it simultaneously faces the emitter element 32 and the receiver element. In addition, the signal reflected by the reflecting element and received by the sensor 34 must be processed taking into account the transit time or the variation in the intensity of the radiation reflected by the moving body itself. In the first case, the reference parameter processed by the control unit 31 is the speed at which the radiation propagates (substantially the same as the speed of light) and therefore the signal processing circuit must permit a very high sampling frequency. In the second case, the circuit that processes the signal of the control unit 31 may be much less sophisticated, since the intensity of the radiation varies with the square of the distance of the moving body relative to the source. Therefore, in the unit 1, the control unit 31 is interfaced with the sensor 34 to measure the variation in the intensity of the radiation received in the form of infrared rays.

With reference to FIG. 2, the unit 1 also comprises a convex body 36 made on the handgrip 23 of the pin 21 and which is located on the vertical of the sensor 34 when the front section of the handgrip 23 of the pin 21 is in contact with the selected weight 10 during use. In this position, the convex body 36 can reflect the infrared rays in a propagation direction that is substantially coincident with the direction of propagation of the incident rays. The body 36 is made of a material that reflects infrared rays or, at least, is covered by a film that reflects infrared rays. In particular, the convex body 36 is delimited by a cylindrical surface 40 that is coaxial with the stem 22. Hence, the angular position of the pin 21 has no influence on the correct operation of the unit 1.

Figure 5:
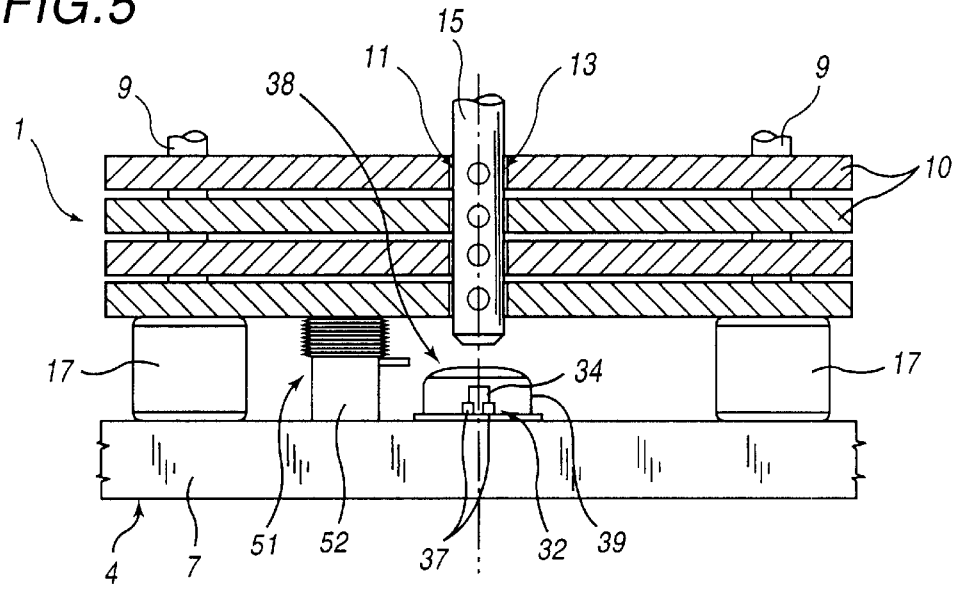
FIG. 5 is a scaled-up front view, with some parts cut away for clarity, of a part of FIG. 1.

Normally, the sensor 34 is positioned around the vertical center line through the axis of the pin 21 and the emitter element 32 comprises an upward-facing emitter 37 located next to the sensor 34, and thus on the line joining the emitter element to the pin 21, so as to follow the same optical path as the incident rays issuing from the emitter element 32. With reference to FIG. 5, the emitter element 32 comprises a plurality of emitters 37 located around the sensor 34. As shown in FIG. 5, the unit 1 comprises a protecting device 39 designed to prevent dust from settling on, and hence blacking out, the optical elements, that is, the emitters 37 and the sensor 34. In FIG. 5, the device 38 is a very simple device comprising a guard consisting simply of a domed casing 39 made of a material that is transparent to infrared rays and that is preferably anti-static so as to repel dust. In FIG. 5, an electrical connection keeps the hollow casing 39 permanently connected to a conventional source to an electrical charge of known polarity (not illustrated). The casing 39 is preferably kept electrically neutral by simply connecting it to ground.

Thanks to the above-described arrangement of emitters 37, sensor 34 and body 36, the directions of propagation of the incident rays and of the rays reflected by the cylindrical surface 40 substantially coincide with each other and are substantially vertical. This maximizes the possibility that the body 36 will be struck by a beam of infrared radiation during use, irrespective of its position along the vertical, and that the sensor 34 will detect the reflected rays.

The use of the unit 1 can easily be understood from the above description. It should be noted that the radiation produced by the emitters 37 reach the sensor 34 after following an optical path that is approximately twice the distance between the emitters 37 and the lower portion of the body 36. Obviously, the minimum distance is that measured when the load is at rest, just before being lifted, and the maximum distance is that measured when the pin 21 has been lifted as high as possible, when the user passes from the concentric stage of the exercise to the eccentric stage. In any case, the maximum and minimum path lengths are in the same order of magnitude. That makes it possible to keep the unit 1 under the same operating conditions at all stages of the exercise and thus facilitates the processing by the control unit 31 of the electronic signal produced by the sensor 34. In particular, during the initial stage, the length of the optical path that separates the emitters 37 from the pin 21 is a little larger than the thickness of the stack of weights 10 located under the pin 21, and thus of the weights 10 which the frame 4 supports during the exercise. During the training, the length of the optical path increases as the user lifts the load but cannot be longer than the maximum stroke possible for the topmost weight 10 on the rods 9.

It follows that, for the same height of weights 10 lifted, the smaller the load selected by the user with the pin 21, the longer the distance traveled by the infrared rays during the performance of an exercise. The maximum length is obtained by combining the smallest possible load with the longest stroke of the training tool. This maximum length helps the designer to choose the most suitable type of receiver element: the greater the distance that has to be covered by the rays in order to be detected, the more sensitive the detecting element must be.

Since the unit 1 makes it possible to measure from a distance the selected load and its related time-dependent movement, it follows that the elements 32 and 34 of the card 30 and the control unit 31 can be considered as remote means for measuring the load in order to calculate training parameters.

Finally, it is clear that the unit 1 described and illustrated herein can be subject to modifications and variations without departing from the protective ambit of the invention.

For example, the variability of the lengths of the paths followed by the infrared rays and hence the cost of the emitter element 32 and receiver element can be reduced by making these lengths dependent only on the stroke of the training tool. Once way of doing this is to use the trough bar 15 as the element that reflects the infrared rays. To do this, the lower end of the through bar 15 would be machined in such a way as to create a reflecting face opposite the emitter element 32. In this way, the emitters 37 and the receiver element would be kept opposite each other at all times. Obviously, because the card 30 can move on the crossbar 8, the reflecting face must be made at the top end of the through bar as well.

Figure 4:
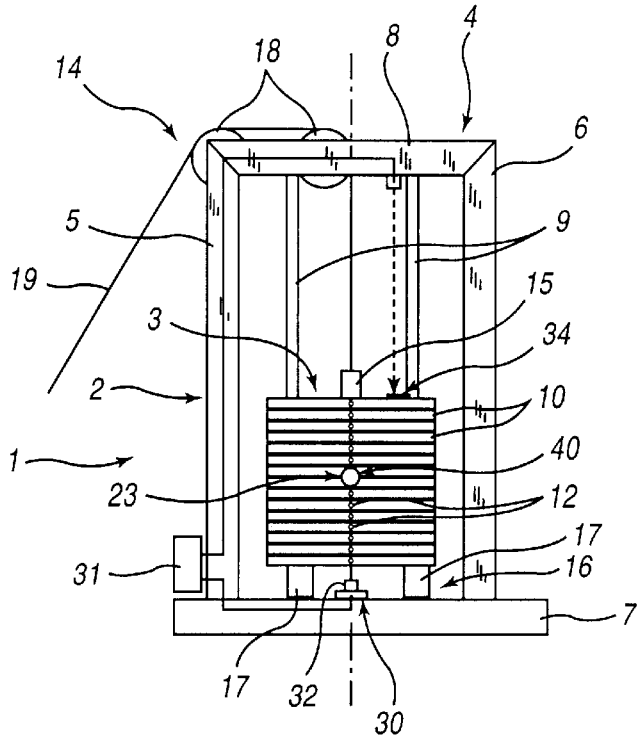
FIG. 4 is a front view of a part of a weight-stack gym machine equipped with a second preferred embodiment of the unit illustrated in FIG. 1.

Another embodiment of the unit 1 is described with reference to FIG. 4 where two pairs, each consisting of an emitter element 32 and a receiver element 34, are used. In particular, a first pair is mounted on the upper crossbar 8 in a position facing the top weight 10, and the second pair on the lower crossbar 7 in a position facing the convex body 36. Hence, the doubling of the ports used to exchange the signals relating to the calculation of the load to be lifted and the current position of the weights during lifting (and therefore also of the training parameters) confers greater sensitivity on the unit 1 during the working stage corresponding to the maximum lift. Under these conditions, the infrared rays follow the shortest path, irrespective of the user's lifting capacity.

With reference to FIG. 5, the efficiency of the protecting device 38 can be improved by using a blowing element 51 equipped with at least one nozzle directed at the outer surface of the domed casing 39 and which can be activated at preset intervals. If the stop blocks 17 are equipped with spring dampers so that the distance of the weight 10 from the crossbar 7 varies during an exercise, the blowing element 51 comprises an air tank 52 that can be deformed by the bottom weight 10 on account of the variation in the load acting on the weight as it moves downward following the return to the rest position of the weights 10 that had been previously lifted. In this case, the air tank 52 is activated at the end of each exercise and hence frequently enough to prevent dust from settling on the casing 39.

If the machines are used in particularly dusty environments, for example near a beach, the blow tank 52 could be substituted by a compressed air cylinder, rechargeable by hand, of the known type and therefore not illustrated. In this case, the air supply could be controlled by the pressure exerted on the cylinder nozzle by the weights as they move down. This pressure could be exerted either directly or through a mechanism actuated by the weights 10 as they move. Alternatively, to relieve machine attendants of the responsibility of periodically recharging the compressed air cylinders, the cylinder device might be substituted with a device having an electromechanical compressor.

Figure 6:
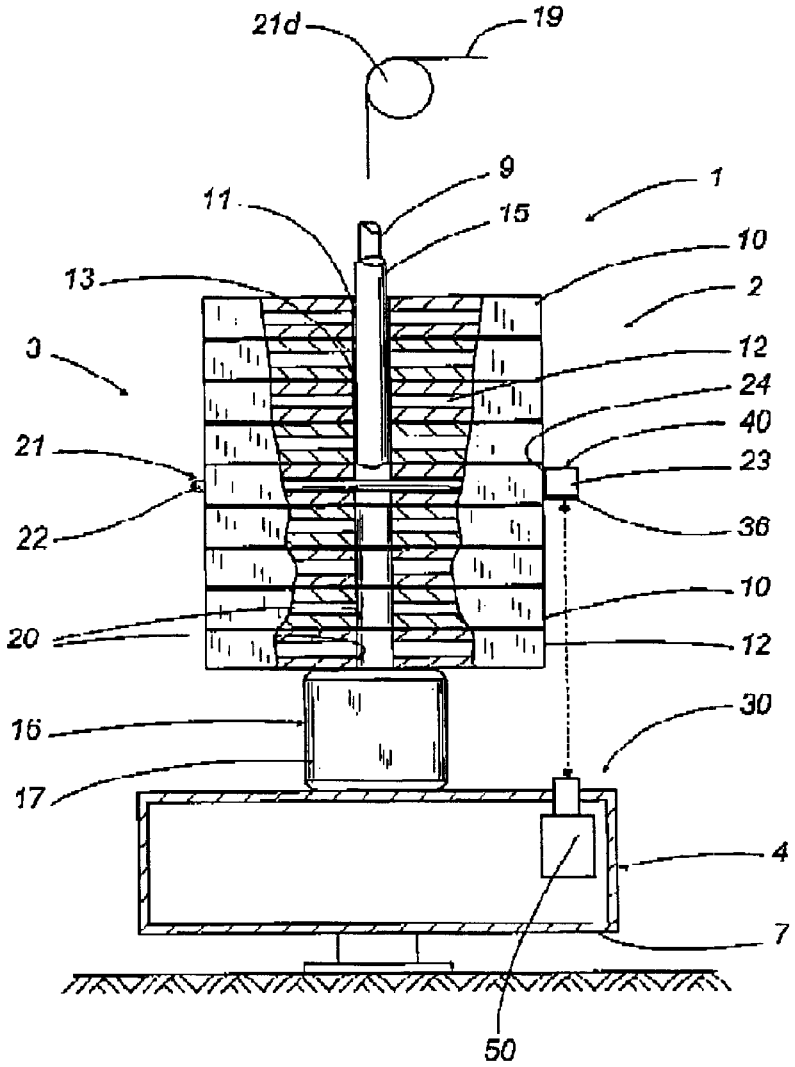
FIG. 6 is a schematic partial representation showing parts of the invention in an embodiment alternative to FIG. 2.
Figure 7:
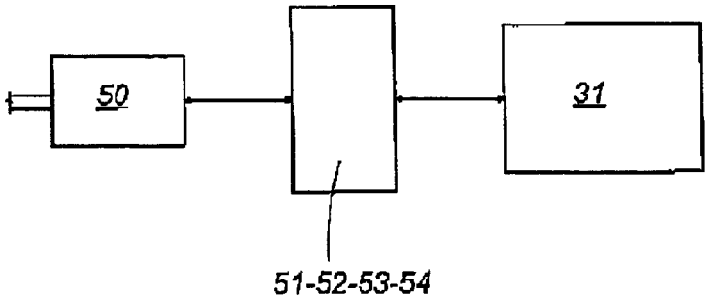
FIG. 7 is a block diagram of the embodiment illustrated in FIG. 6.

Yet another embodiment of the invention, illustrated in FIG. 6, is equipped with remote detector means 30 which comprise optical means designed to detect the position of the selection means 21 in order to measure their distance from a fixed element, that is, from one of the crossbars 7; 8 of the frame 4, not only when the selection means 21 are stationary and attached to the load unit 3 under machine 2 rest conditions, but also when the selection means 21 are moving relative to the fixed element 7; 8 during the performance of an exercise on the machine 2.

Looking in more detail, the optical means comprise a camera 50 and interface means 51; 52, 53; 54 to connect the camera to the electronic computing means 31. The exchange of signals between the camera 50 and the electronic computing means 31, processed by appropriate algorithms, makes it possible to instantaneously locate the selection means 21 relative to the fixed element 7; 8 of the frame 4 in order to calculate, under stationary conditions of the load unit 3, the total weight set by the user; whereas, under conditions of movement, the kinematic variables necessary to calculate the dynamic training parameters are calculated.

The interface means may be made according to several different embodiments comprising the following components, without excluding others, for the exchange of signals between the camera 50 and the electronic computing means 31; a parallel interface 51; an interface 52 for a composite signal and a corresponding digitizing card 53; or even a USB interface 54.

Another feature of the invention is the possibility of including detector means 55 designed to discriminate between the stationary state and the moving state of the selection means 21 when these are connected with the load unit 3. This discrimination may be useful for numerous purposes, including that of correlating the moment when the measuring unit starts operating with the movement when the load unit 3 starts moving, or that of varying, during the passage from the static to the dynamic state, and vice versa, the characteristics of certain operating parameters such as the sampling frequency of the camera 50 and/or of other characteristic parameters of the equivalent optoelectronic means described above as a possible embodiment of the remote measuring means 30.

Figure 8:
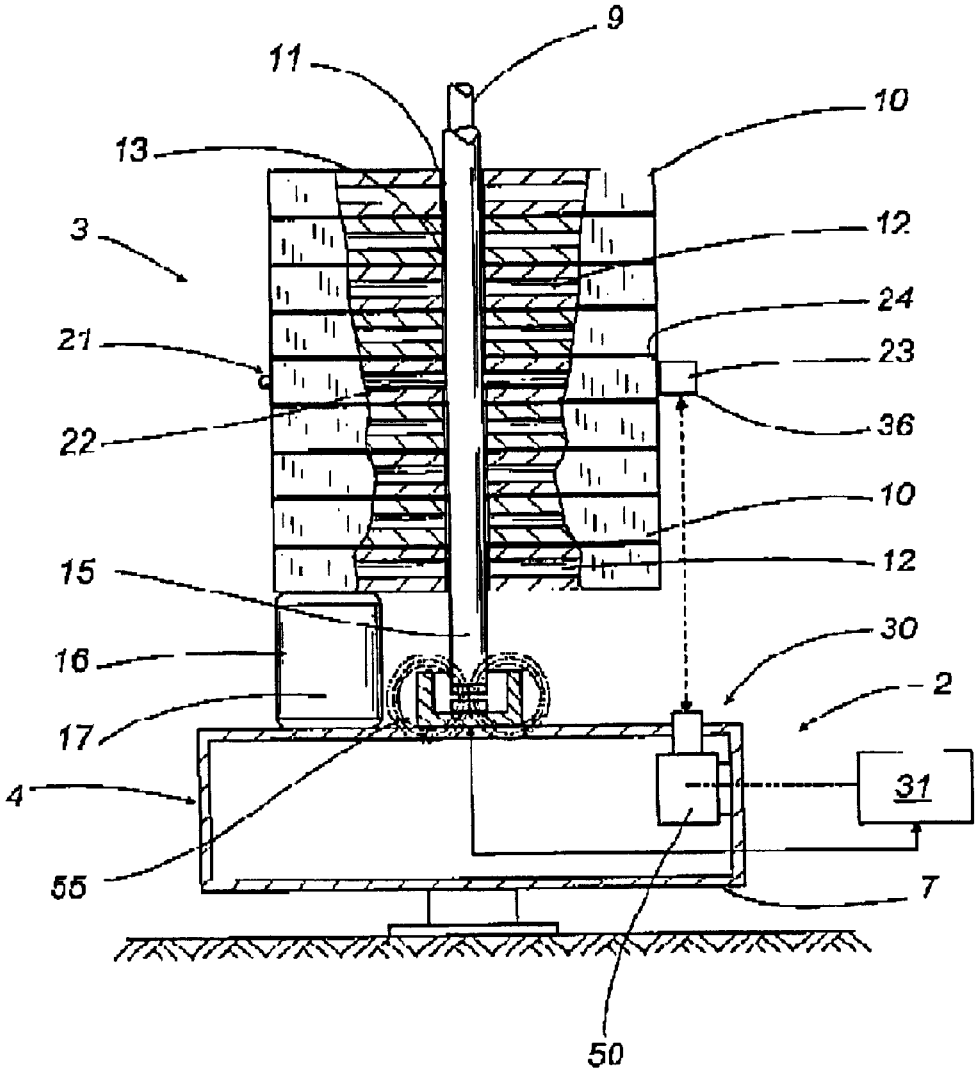
FIG. 8 is a scaled-up schematic representation of a part of the machine showing another salient feature of the invention.

In a preferred embodiment, shown in FIG. 8, and that is particularly advantageous for its low cost and high degree of reliability, these measuring means consist of a magnetic proximity sensor 55 located between one end of the selection bar 15 and one of the fixed elements 7; 8 opposite it on the machine 2, and are electronically connected to the electronic computing means 31.

In another embodiment, these measuring means might even be used simply as a switch between the static condition where the weight stack is selected and the dynamic condition of the machine where the user is exerting force in order to lift the load. Accordingly, these measuring means might also be used in conjunction with the solution described in prior art where a cable is used to detect the position of the weight selection pin, that is, by using a device 21*d* (encoder) for measuring the movement of the weight stack. This would solve the problems connected with unreliable operation and detection since the use of a magnetic coupling would provide a reliable, error-free ON/OF detection system. Moreover, such a detection device could be built into a separate unit that could be easily located under the weight stack and retrofitted on existing machines without having to change the programming of the unit for controlling and measuring both the selected weights and the data processing and speed functions during the exercises.

The invention described can be subject to modifications and variations without thereby departing from the scope of the invention concept. Moreover, all the details of the invention may be substituted by technically equivalent elements.

What is claimed is:

1. A measuring unit comprising a weight-stack gym machine having a frame with at least one upright and at least one crossbar; the frame support at least one substantially vertical rod, the machine further having a load unit with a plurality of stackable weights, wherein each weight has a through hole formed therein to define a substantially vertical, cylindrical channel, the load unit comprising a through bar extending through said channel and having a plurality of transversal holes spaced apart from each other at a distance proportional to a thickness of the weights; lifting means comprising at least one flexible cable connected to the through bar and designed to actuate the through bar in a direction parallel to the rod; and means for selecting on of said plurality of transversal holes designed to detachably connect a weight to the through bar to isolate a part of the weights, the measuring unit comprising remote load measuring means for calculating static and dynamic training parameters; said remote load measuring means comprising at least one electromagnetic radiation emitter element mounted at a defined point on the frame, at least one reflecting element facing the emitter element and selectively connected to at least one of the weights, and a receiver element mounted on the frame at a point facing the reflecting element; electronic computing means mounted on the frame and electrically connected to the emitter and receiver elements to continuously calculate a distance separating the emitter and receiver elements in a defined mode; said emitter and receiver elements both being substantially aligned with the vertical bar and said reflecting element being mounted at the bottom end of the through bar to reflect the electromagnetic waves of the vertical bar.

2. The unit according to claim 1, wherein the selection means comprise a selector element with a handgrip and a long stem designed to transversely engage the through bar at one of the holes, wherein the reflecting element is connected to the selector element.

3. The unit according to claim 2, wherein the reflecting element is peripherically delimited by a substantially convex surface shaped in such a way as to reflect the electromagnetic radiation issuing from the emitter element in a propagation direction that substantially coincides with the line joining the reflecting element to the receiver element.

4. The unit according to claim 1, wherein the selection means comprise a selector element with a handgrip and a long stem designed to transversely engage with the through bar at one of the holes, wherein the handgrip has a front portion that rigidly supports the selector element.

5. The unit according to claim 4, wherein the emitter and receiver elements are positioned close to each other wherein a direction of the radiation issuing from the emitter element and the direction of the radiation reflected by the front portion are substantially coincident.

6. The unit according to claim 5, wherein the emitter element in turn comprises a plurality of emitters of electromagnetic radiation distributed uniformly around the emitter element.

7. The unit according to claim 6, wherein the receiver element comprises at least one sensor designed to detect the electromagnetic radiation emitted by the emitter element and reflected by the reflecting element.

8. The unit according to claim 7, wherein the control unit interfaces with the sensor and calculates a transit time of the reflecting element in a path defined by the emitter element and the sensor.

9. The unit according to claim 3, wherein the convex surface is cylindrical in shape.

10. The unit according to claim 1, wherein the emitter and receiver elements are mounted on an electronic card.

11. The unit according to claim 10, wherein the receiver element is screened from visible light.

12. The unit according to claim 10, wherein the electronic computing means comprise an electronic control unit mounted on the frame and a digital driver element mounted on the card and designed to control the emission of the electromagnetic radiation by the emitter element.

13. The unit according to claim 1, wherein the reflecting element comprises a face oriented in a direction substantially transverse the lengthways axis of the through bar wherein the emitter and receiver elements are always opposite each other reflected in the face itself.

14. The unit according to claim 1, further comprising at least one first emitter element of electromagnetic radiation mounted on the frame vertically aligned with the weights, at least one first reflecting element selectively connectable to at least one of the weights and vertically facing the first emitter element, and a first receiver element mounted on the frame at a point facing the first reflecting element; at least one second emitter element of electromagnetic radiation mounted on the frame vertically aligned with the weights, at least one second reflecting element mounted rigidly on the weight that delimits the top/bottom of the stack of weights and located vertically with the second emitter element, and at least one second receiver element mounted on the frame vertically with the second reflecting element; the electronic computing means being electrically connected to the first and second emitter and receiver elements to continuously measure the length of the path separating the first emitter and receiver elements and the second emitter and receiver elements.

15. The unit according to claim 1, wherein the electromagnetic radiation is of the infrared type.

16. The unit according to claim 1, further comprising a protecting device that prevents dust from settling on the emitter and receiver elements.

17. The unit according to claim 16, wherein the protecting device comprises at least one hollow casing covering at least one of the emitter and receiver elements, said hollow casing being made of transparent material.

18. The unit according to claim 17, wherein the hollow casing is made of anti-static material.

19. The unit according to claim 17, wherein the protecting device comprises an electrical connection acting on the hollow casing to keep the hollow casing under desired electrostatic conditions.

20. The unit according to claim 19, wherein the electrical connection is a ground connection to keep the hollow casing electrically neutral.

21. The unit according to claim 17, comprising a cleaning device for mechanically removing dust from the hollow casing; said cleaning device being mounted on the frame on the same side as the hollow casing.

22. The device according to claim 21, wherein the cleaning device comprises blowing means with at least one nozzle directed at the hollow casing and supplied with compressed air to mechanically remove dust from the hollow casing.

23. The unit according to claim 22, wherein the blowing means comprise a compressed air tank deformable by the weight delimiting a bottom of the load unit.

24. The unit according to claim 22, wherein the blowing means comprise a rechargeable compressed air cylinder.

* * * * *